US005937608A

United States Patent [19]

Kucirka

[11] Patent Number: 5,937,608

[45] Date of Patent: Aug. 17, 1999

[54] JOIST BRIDGING

[76] Inventor: Mark J. Kucirka, 1275 Weaversville Rd., Northampton, Pa. 18067

[ * ] Notice: Under 35 U.S.C. 154(b), the term of this patent shall be extended for 771 days.

[21] Appl. No.: 08/502,276

[22] Filed: Jul. 13, 1995

Related U.S. Application Data

[63] Continuation-in-part of application No. 08/067,136, May 26, 1993, abandoned.

[51] Int. Cl.[6] ..... E04C 3/02; E04G 23/00

[52] U.S. Cl. ..... 52/695; 52/693; 52/713; 52/105; 52/291; 52/741.1

[58] Field of Search ..... 52/693, 694, 695, 52/696, 712, 713, 105, 291, 741.1

[56] References Cited

U.S. PATENT DOCUMENTS

| | | | |
|---|---|---|---|
| 457,664 | 8/1891 | Paine | 52/695 |
| 777,742 | 12/1904 | Parent | 52/694 |
| 1,106,844 | 8/1914 | Ream | 52/695 |
| 1,106,845 | 8/1914 | Ream | 52/695 |
| 1,496,133 | 6/1924 | Rothrock | 52/695 |
| 1,523,711 | 1/1925 | Powell | 52/695 |
| 1,642,945 | 9/1927 | Davidson | 52/693 X |
| 1,649,226 | 11/1927 | Gstalder | 52/695 |
| 1,656,741 | 1/1928 | Lane | 52/695 |
| 1,685,729 | 9/1928 | Stone | 52/695 |
| 1,734,701 | 11/1929 | White | 52/693 X |
| 1,735,591 | 11/1929 | White | 52/695 |
| 1,934,708 | 11/1933 | Hatch | 52/695 |
| 2,442,726 | 6/1948 | Gstalder | 52/695 |
| 2,565,875 | 8/1951 | Musacchia | 52/695 |
| 2,914,816 | 12/1959 | Lundgren | 52/695 X |
| 2,963,127 | 12/1960 | Manville | 52/693 |
| 3,077,009 | 2/1963 | Taber et al. | 52/695 X |
| 3,102,306 | 9/1963 | Hutchinson | 52/695 X |
| 3,596,941 | 8/1971 | Tracy | 52/713 X |
| 4,016,698 | 4/1977 | Rogers | 52/693 X |
| 4,038,803 | 8/1977 | Schoeller | 52/695 X |
| 4,040,232 | 8/1977 | Snow et al. | 52/693 X |
| 5,224,309 | 7/1993 | Bodell | 52/105 X |

FOREIGN PATENT DOCUMENTS

| | | | |
|---|---|---|---|
| 323249 | 7/1957 | Switzerland | 52/693 |
| 2044330 | 10/1980 | United Kingdom | 52/713 |

OTHER PUBLICATIONS

"RAPZ Strapping Products, Steel Strapping Tools and Accessories", RAPZ Strapping Products, pp. 1–21, 1990.

*Primary Examiner*—Carl D. Friedman
*Assistant Examiner*—Laura A. Callo
*Attorney, Agent, or Firm*—LaMorte & Associates

[57] ABSTRACT

Bridging is provided for use in joining joists or like construction elements so as to increase the strength and stability of those elements. The present invention utilizes flexible strapping to create the bridging structure, wherein a first flexible strap is attached to a first joist and a second flexible strap is attached to a second joist. The bridging structure is created by aligning the straps between the joists and joining the straps together. The various flexible straps can be directly attached to the joists, however when applied to wooden joists, stiffened supports are preferably positioned between the joists and the flexible strapping. The stiffened supports spread the force of the flexible strapping and prevent the strapping from deforming the material of the joist. To add to the integrity of the bridging structure, the stiffened supports can be mechanically or adhesively joined to the joists and the flexible strapping can be mechanically or adhesively joined to the stiffened supports and joists.

26 Claims, 13 Drawing Sheets

24 INCH
24 INCH
8 10 12 14 16
8 10 12 14 16
75
76
77
78
79
$D_1$
12
85
86
87
89
95
$D_2$

JOIST BRIDGING

CONTINUATION IN PART

This application is a Continuation In Part of U.S. patent application No. 08/067,136 filed May 26, 1993 now abandoned and also entitled JOIST BRIDGING.

BACKGROUND OF THE INVENTION

I. Field of the Invention

The present invention relates to bridging structures for use between joists or other similar construction elements. More particularly, the present invention relates to flexible bridging, such as strapping, that can be applied with a selectively adjustable tension and/or length between adjacent joists.

II. Prior Art Statement

Bridging is commonly used between floor joists, roof rafters, beams, trusses, framing studs and similar construction elements to increase the strength and stability of those elements. However, the advantages of bridging can be best explained when applied to a floor joist construction.

The use of bridging between joists in a floor construction increases the load bearing capacity of the floor. Bridging mechanically joins the various floor joists together. As such, bridging restrains the independent movement of any single joist. Bridging therefore helps keep the various joists straight and parallel to one another. Restraining joists from twisting along the line of bridging increases the strength and stiffness of individual joists. When individual joists are loaded without bridging, the individual joists may bend and twist under the load and move away from their desired vertical orientation. As a result, the load bearing capacity of the twisted joist is greatly reduced. Bridging joins joists together in a manner that limits the amount of twisting each joist can experience. Bridging also acts to spread a concentrated load positioned atop a single joist among the surrounding joists. Consequently, bridging increases the static stiffness and strength of the floor. In view of the increase in structural strength and stiffness created by bridging, the load bearing capacity manufactured into individual joists can be reduced, thereby enabling joists to be manufactured with both a material and labor savings.

Although floors are designed with static strength and deflection constraints, the floor's dynamic performance often determines the perceived quality of the overall construction. Floors which never fail due to strength or static deflections may not prevent annoying vibrations from arising due to the dynamic loads of occupants in motion.

The availability of higher strength materials has reduced the weight and size of structural members and have made floor systems more sensitive to vibrations. Costly measures are commonly taken to reduce occupant induced floor vibrations. For instance, oversized joists are often selected. Alternatively, the floor deck is often glued to increase composite action between the deck and joists. The cost of these construction practices add to both the labor and costs of installing the flooring.

Increasing floor stiffness transverse to the direction of the joist span is advantageous in that it provides a more efficient means of reducing vibration than does increasing floor stiffness in the direction of the joist span. This is because the vibrational mode shapes develop transverse to the joist span in the direction of the bridging line.

Effective bridging efficiently increases floor stiffness transverse to the joist span and restrains rotation of the joist.

These effects raise the fundamental frequency of the floor and separate closely spaced frequency modes which can interact to amplify vibrational amplitudes.

One type of conventional bridging often used in residential construction comprises two pieces of lumber installed between adjacent joists in an X-shaped pattern. Each piece of lumber is then nailed at its upper and lower ends between each joist. A similar type of conventional bridging utilizes pieces of lumber cut to the correct length to fit between adjacent joists with respect to the center-to-center joist spacing. Each end of the lumber is then nailed directly to the joist it contacts. Both bridging types require lumber to be cut to size and nailed to the joists. As such, lumber-based bridging is highly time consuming and labor intensive.

In an attempt to reduce the time and labor involved with lumber based bridging, prefabricated steel bridging devices have been widely developed throughout the prior art. The simplest form of this prefabricated metal bridging is comprised of two metal brackets. Each metal bracket is then directly nailed to the vertical walls of adjacent joists to form an overall X-shaped configuration. Such prior art bridging devices are exemplified in U.S. Pat. No. 459,900 to Moore, entitled BRIDGING FOR FLOORING JOISTS; U.S. Pat. No. 682,086 to Kearney, entitled CROSS BRIDGE; U.S. Pat. No. 918,949 to Bertram, entitled JOIST BRIDGING; U.S. Pat. No. 3,018,522 to Reidelbach, entitled METAL BRIDGING FOR JOISTS; and U.S. Pat. No. 2,803,045 to Horner, entitled JOIST BRACE. A similar type of prior art metal bridging also utilizes two metal brackets nailed between joists in an X-shaped configuration. However, the ends of each bracket are nailed to the top and bottom horizontal surfaces of the joists, rather than to the vertical sides of the joists. Such prior art bridging is exemplified by U.S. Pat. No. 2,565,875 to Musacchia, entitled RIBBED METAL CROSS BRIDGING; U.S. Pat. No. 2,455,904 to Meulenbergh, entitled METAL CROSS BRIDGING; and U.S. Pat. No. 1,685,729 to Stone, entitled BRIDGING CONSTRUCTION FOR JOISTS.

The strength, rigidity and method of installment of the above described lumber-based and metal bridging are problematic. The relatively large cross sectional stiffness and configuration of these prior art bridging types result in high loads on connections. The relatively large stiffness of prior art bridging in relation to that of the joist span results in heavy loads being carried by the bridging. In such prior art bridging, the strength of the bridging is dependent upon the size and number of nails used to secure the bridging to the joists. As such, the strength of the bridging can be no greater than the forces retaining the anchoring nails within the joists. Prior art bridging which terminates at its connection to the joist must transfer all loads in the bridging element to the joist. In many load cases, bridging elements connected to both sides of the joist's top or bottom edge are loaded in tension. If the bridging element were continuous over the joist edge, only the difference in horizontal components of the bridging's tension forces are transferred to the joist on either side of the joist. Therefore, the connections of prior art bridging which terminates at the joist are subjected to much higher loads than bridging which is continuous over the joist. As a result, connections of bridging terminating at the joist are severely overloaded, resulting in a loss of connection rigidity. Moreover, the overloaded nails are prone to squeaking. Repairs for floor squeaking are troublesome and costly. Furthermore, prior art cross bridging which terminates at the joist requires twice the number of connections as bridging which is continuous over the joist. One connection of continuous bridging simultaneously attaches two bridging elements to the joist.

Prefabricated metal bridging has further disadvantages in that the bridging is prone to improper installation methods that adversely affects the rigidity of the bridging. Certain prior art metal bridging devices require that the bridging be bent to the angle of the joist prior to being nailed to the joist. Sharply bending the metal bridging at the proper position by hand is problematic. Some prior art metal bridging is manufactured with prefabricated holes through which the nails can be driven. Commonly, such metal bridging bends at the points of the nail holes rather than at the proper point of flexure. As a result, the bends that occur in such metal bridging are seldom at the proper location. The bridging must bend at the proper points of flexure and straighten out any kinks before the bridging can transfer significant loads between joists. Consequently, the misplaced bend causes points of slack in the bridging that lessen the rigidity, and consequently the effectiveness of the bridging.

Prefabricated metal bridging that attaches to the horizontal surfaces of joists is particularly difficult to install. For each bridging bracket, the upper end of the bracket must be nailed before the floor decking is installed. This may require a hazardous balancing act while working from the top of the suspended joists. Working overhead while standing on a raised work surface makes connecting the bridging to the underside of a joist difficult. Moreover, fastening the bridging requires one hand to hold the nail; the other hand to hold the hammer; and the mythical third hand to properly position the bridging. Furthermore, when installing such bridging on joists, workmen may nail the bridging bracket too close to the edge of the joist or fail to drive the specified amount of nails through the bridging into the joist. If such mistakes occur, the strength of the bridging design is greatly undermined. Furthermore, variations in the joist spacing and depth cannot be easily compensated for by the prefabricated bridging. Nail holes are provided only at certain locations on some metal bridging, as is exemplified by U.S. Pat. No. 1,523,711 to Powell, entitled BUILDERS HARDWARE STRIPS WITH MULTIPLE HOLES. When such prior art bridging is installed, one end of the bridging is nailed down first. consequently, it is possible for the other end of the bridging to misalign with the joist edge and therefore the nail holes, present in the bridging, may not align over the center of the joist. If the nails are attached too close to the edge of the joist, the joist may splinter and the bridging may detach as the bridging and the floor joists are repeatedly stressed. It can therefore be seen that with certain prior art devices, small variations in the position of the joists may create an inferior bridging installation.

In an attempt to solve the problems of nailing and fit that are prevalent with static prefabricated metal bridging, adjustable bridging has been developed in the prior art. In such adjustable bridging, the lengths of the various bridging members can be selectively adjusted. consequently, the bridging can be properly installed despite small variations that may exist among the joists. Such prior art bridging devices are exemplified by U.S. Pat. No. 3,102,306 to Hutchinson, entitled METHOD OF MANUFACTURING BRACING; U.S. Pat. No. 1,496,133 to Rothrock, entitled ADJUSTABLE WOOD CROSS BRIDGING FOR FLOORS AND JOISTS; U.S. Pat. No. 2,623,246 to Pestak, entitled BRIDGING FOR FLOOR JOISTS and U.S. Pat. No. 3,077,009 to Taber, entitled BRACING. The problem with such bridging is that it requires telescoping members, or other various complicated slide adjustments that are expensive to manufacture. Consequently, the cost of such bridging is expensive as compared to other conventional bridging.

In view of the prior art in bridging for joists, there exists a need for a bridging device that is adjustable in its application, simple to install rigidly, can be connected to joists before the joists are installed, is inexpensive to manufacture, is continuous over the joists to reduce loads on connections and the number of connections and does not rely on hand driven nails as the sole means of providing connection rigidity. All these criteria are provided for by the present invention herein described.

SUMMARY OF THE INVENTION

The present invention is bridging for use in joining joists or like construction elements so as to increase the strength, stiffness and stability of those elements. The present invention utilizes substantially flexible strapping to create the bridging structure, wherein a first flexible strap is attached to a first joist and a second flexible strap is attached to a second joist, be it adjacent to the first joist or otherwise. The bridging structure is created by aligning the straps between the joists in an overlapping fashion and joining the straps together so that the predetermined tensile force and/or distance is maintained between the joists. The various flexible straps can be directly attached to the joists, however when applied to wooden joists, stiffened supports are preferably positioned between the joists and the flexible strapping. The stiffened supports spread the force of the flexible strapping and prevent the strapping from deforming the wooden joists. To add to the integrity of the bridging structure, the stiffened supports can be mechanically, adhesively or otherwise joined to the joists and the flexible strapping can be mechanically, adhesively or otherwise joined to the stiffened supports.

Once the flexible strapping is attached to a plurality of joists, the aligned and overlapping straps can be tensioned utilizing a commercially available tensioner device. When the desired tension has been established, the overlapping strapping is physically joined using a mechanical fastener, mechanical crimp, or other joining means. Once the flexible strapping is in place, each of the joists are joined by the taut strapping, as such a highly effective and inexpensive bridging structure is created. Furthermore, the present invention bridging can be used to correct misaligned joists. To correct such misaligned joists, flexible strapping is applied to the misaligned joist in orientations that act to correct the misaligned joist when tension is applied to the flexible strapping. Consequently, joists can be selectively rotated, raised or lowered as desired.

BRIEF DESCRIPTION OF THE DRAWINGS

For a better understanding of the present invention, reference is made to the following descriptions of exemplary embodiments thereof, considered in conjunction with the accompanying drawings, in which.

DETAILED DESCRIPTION OF THE INVENTION

Although the present invention bridging can be used in conjunction with any joist structure, such as ceiling joists, roof rafters or the like, it is especially suitable for use in conjunction with flooring joists. Accordingly, the present invention bridging will be described in connection with flooring joist construction. Furthermore, as will be explained, the present invention bridging utilizes flexible strapping in its construction. The flexible strapping can be made of any material, either natural or synthetic, that exhibits a high tensile strength and stiffness yet is substantially flexible. In the below described embodiments, metal strapping is used because metal strapping has a high tensile strength, is highly flexible, can be readily connected to various materials, is widely commercially available and is relatively inexpensive. However, it should be understood that the strapping can be made from other materials.

Figure 1:
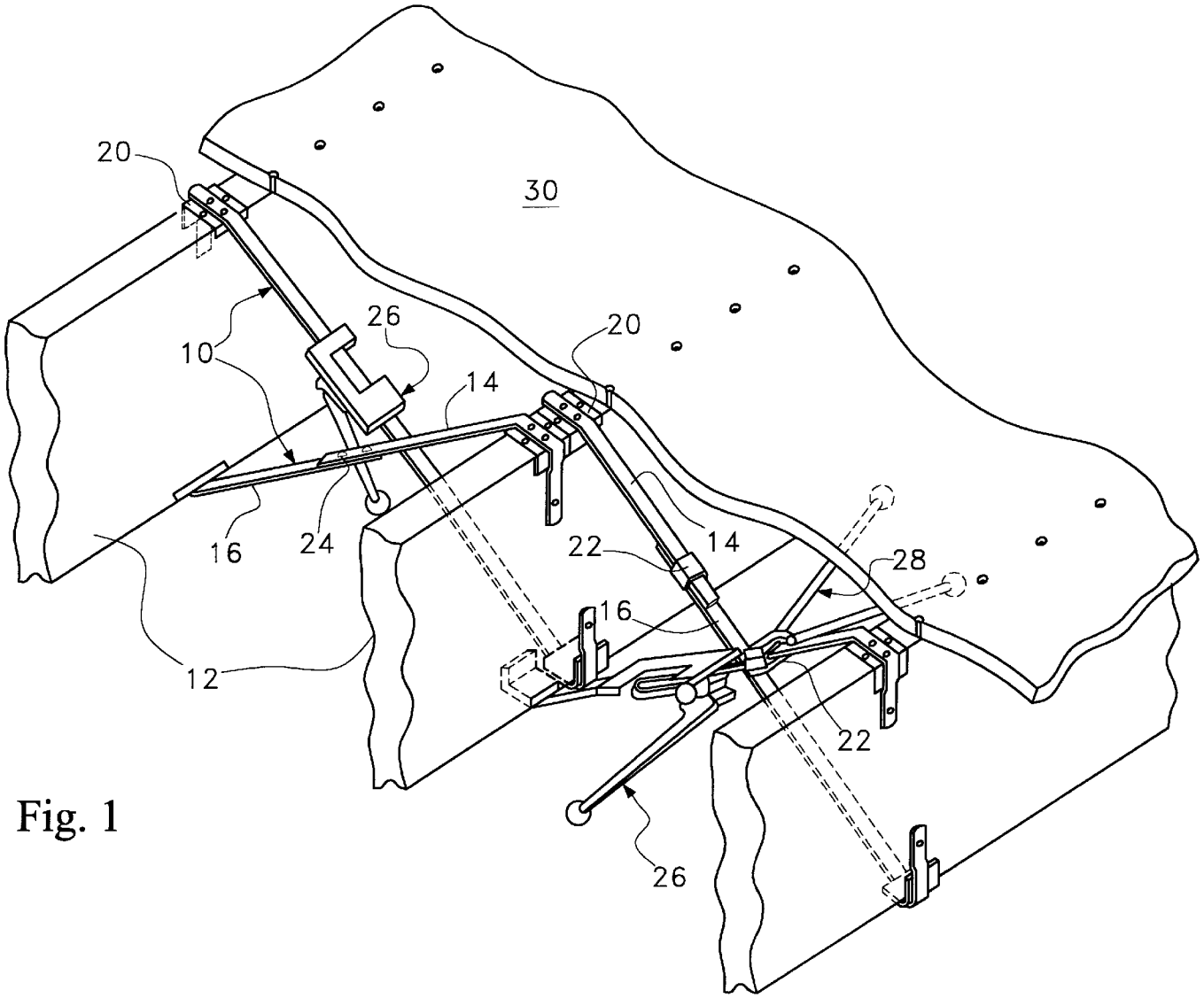
FIG. 1 is a perspective view of a floor joist arrangement including a bridging structure that has been constructed in accordance with one exemplary embodiment of the present invention, the floor joist arrangement being shown in a partially segmented fashion to facilitate consideration and discussion.

Referring to FIG. 1, one preferred embodiment of the present invention bridging device is shown in conjunction with a plurality of floor joists 12. In the shown embodiment, an X-shaped bridging configuration is created between joists 12 utilizing pieces of flexible strapping. Each X-shaped bridging configuration is comprised of two flexible bridging elements 10 that extend between adjacent joists in a criss-cross pattern. Each of the flexible bridging elements 10 extend from the top edge of one joist to the bottom edge of an adjacent joist, creating one segment of the X-shaped bridging configuration. Each of the flexible bridging elements 10, in the X-shaped bridging configuration, is itself comprised of two individual flexible straps, shown as upper flexible strap 14, and lower flexible strap 16. An upper flexible strap 14 is attached to the top edge of each of the joists 12. Similarly, a lower flexible strap 16 is attached to the bottom edge of each of the joists 12. Each pair of upper and lower flexible straps 14, 16, disposed on adjacent joists, are aligned in the same plane and are sized to overlap each other when the upper and lower flexible straps 14, 16 are extended toward each other between the adjacent joists. The upper and lower flexible straps 14, 16 can be directly fastened to each of the joists 12, however in a preferred embodiment, the upper and lower straps 14, 16 are each attached to the joists 12 utilizing metal support brackets 20 which will be later described in detail.

The upper and lower flexible straps 14, 16 are preferably identical in width and gauge. In the preferred embodiment, the flexible strapping used to form the upper and lower straps 14, 16, are between ten millimeters and fifty-one millimeters in width and have a gauge of between 0.30 millimeters and 1.45 millimeters in thickness. Such flexible strapping is widely commercially available and is commonly used to bind bulk manufactured goods. However, it will be understood that other widths and gauges can be used depending upon the desired strap loads, connection requirements and strap flexibility. In the shown embodiment, the upper flexible strap 14 and the lower flexible strap 16 are joined together utilizing either a metal seal 22 or are joined together mechanically with a sealless joint 24. Furthermore, the upper flexible strap 14 and the lower flexible strap 16 are joined together at a desired overlapping length or tension. As will be later explained, the ability to selectively change the tension and adjust the overlapping length in the various flexible bridging elements 10 allows the bridging to correct undesired variations in the structure of the joists 12.

The upper and lower flexible straps 14, 16 are joined together using a commercially available flexible strapping tensioner device 26 and a commercially available strap sealing device 28. The flexible strapping tensioner device 26 aligns the upper and lower flexible straps 14, 16 and applies tension between the two straps. The strap sealing device 28 applies a metal seal 22 around the upper and lower flexible straps 14, 16 thereby locking the two straps together at the desired tension and/or overlapping length. Although a flexible strapping tensioner device 26 and strap sealing device 28 are shown, it will be understood that combination devices that perform the tasks of both devices are also commercially available. Similarly, devices are commercially available that can join the upper and lower flexible straps 14, 16 without a metal seal 22, thereby creating a sealless joint 24 that locks the upper and lower straps 14, 16 together with a mechanical crimp. Commercially available devices for tensioning and joining metal strapping can be obtained from RAPZ STRAPPING PRODUCTS of New Britain Connecticut, as well as from several other domestic and foreign manufacturers.

As the upper and lower flexible straps 14, 16 are joined at a desired length and/or tension, each of the joists 12 become interconnected by the resulting flexible bridging element 10. Since each of the flexible bridging elements 10 join the top edge of one joist to the bottom edge of an adjacent joist, the tension within each flexible bridging element 10 applies both a vertical component force and a horizontal component force to each of the joists 12. Consequently, if symmetrically applied on either side of each joist 12, the flexible bridging elements 10 resist both the vertical and horizontal movement of each of the joists 12 and forms a highly effective bridging apparatus. If a flexible bridging element 10 is applied to one side of a joist 12 at a time, the tensioning of the flexible bridging elements 10 may act to displace the joist 12 from its original position. If such bridging were being installed on a previously constructed floor, the floor sheathing 30 would resist any movement of the joists 12. Although attaching the floor sheathing 30 is not a prerequisite for installing the flexible bridging elements 10, it is advantageous to attach the floor sheathing 30 before interconnecting the upper and lower metal straps 14, 16. Proper connection of the floor sheathing 30 to the joist 12 and/or the upper metal strap 14, improves the performance of the overall bridging structure. The floor sheathing 30 restrains the joists 12 and resists the horizontal thrusts of the upper metal strap 14 attached to the top of each joist 12. Moreover, the floor sheathing 30 aids in restraining the vertical deflection of the joists due to the vertical component of the tensioning and the horizontal component of the lower metal strap 16 attached to the underside of each joist 12.

Figure 2:
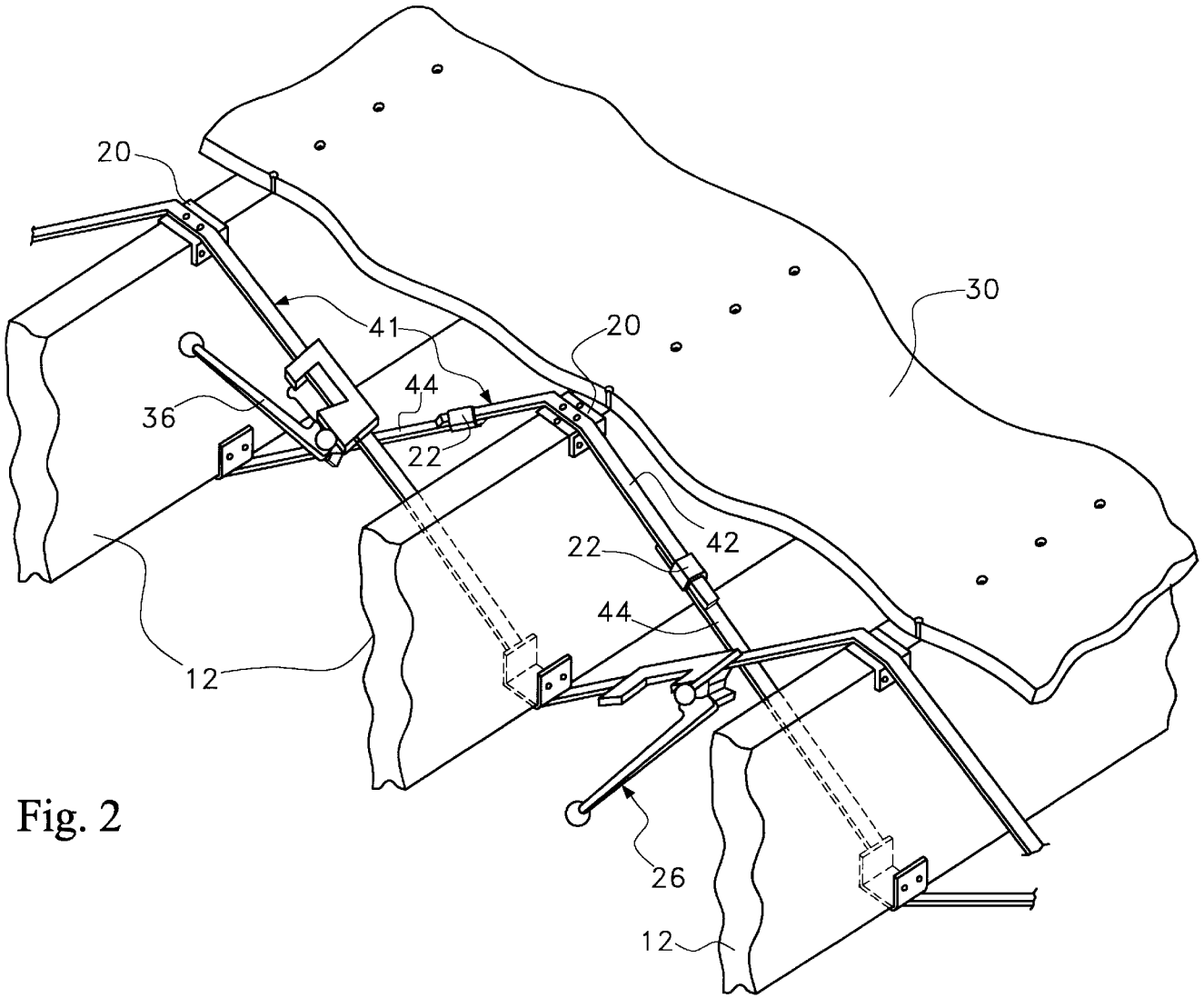
FIG. 2 is a perspective view of the floor joist arrangement of FIG. 1, showing a second exemplary embodiment of the present invention bridging structure.

Referring to FIG. 2, an alternate embodiment of the present invention bridging construction is shown. In this embodiment, the flexible bridging elements 41 are made from pieces of strapping that extend across the top and bottom edges of each of the joists 12, such that each piece of strapping extends beyond both sides of a joist. More specifically, each flexible bridging element 41 is constructed by placing an upper flexible strap 42 atop each of the joists 12. The center of the upper flexible strap 42 is attached to the top edge of a joist 12, such that half of the upper flexible strap 42 extends from one side of the joist 12 and the other half of the upper flexible strap 42 extends from the opposite side of the joist 12. Similarly, a lower flexible strap 44 is attached to the bottom edge of each joist 12. The center of the lower flexible strap 44 is attached to the joist 12 such that half of the lower flexible strap 44 extends from one side of the joist 12 and the other half of the lower flexible strap 44 extends from the opposite side of the joist 12. The upper flexible straps 42 and the lower flexible straps 44, on adjacent joists 12, are aligned along the same line and are sized to overlap each other when extended toward each other. Each end of the upper flexible strap 42 is then joined to the two lower flexible straps 44 that extend from the adjacent joists. Consequently, a continuous line of flexible strapping is formed across all the joists 12 that repeatedly passes across the bottom edges and top edges of adjacent joists. The upper flexible straps 42 are joined to the lower flexible straps 44 at a desired tension and/or overlapping length utilizing a metal strapping tensioner device 26 as has been previously described. The upper flexible strap 42 is then mechanically connected to the lower flexible strap 44 utilizing a metal seal 22 or a sealless joint. To better position the overlapping straps for tensioning and sealing, each strap may be attached to the joist with the center of the strap offset from the joist 12. The upper and lower flexible straps 42, 44 can be directly fastened to each of the joists 12, however in a preferred embodiment, the upper and lower straps 42, 44 are each attached to the joists 12 utilizing metal support brackets 20 which will be later described in detail.

Figure 3:
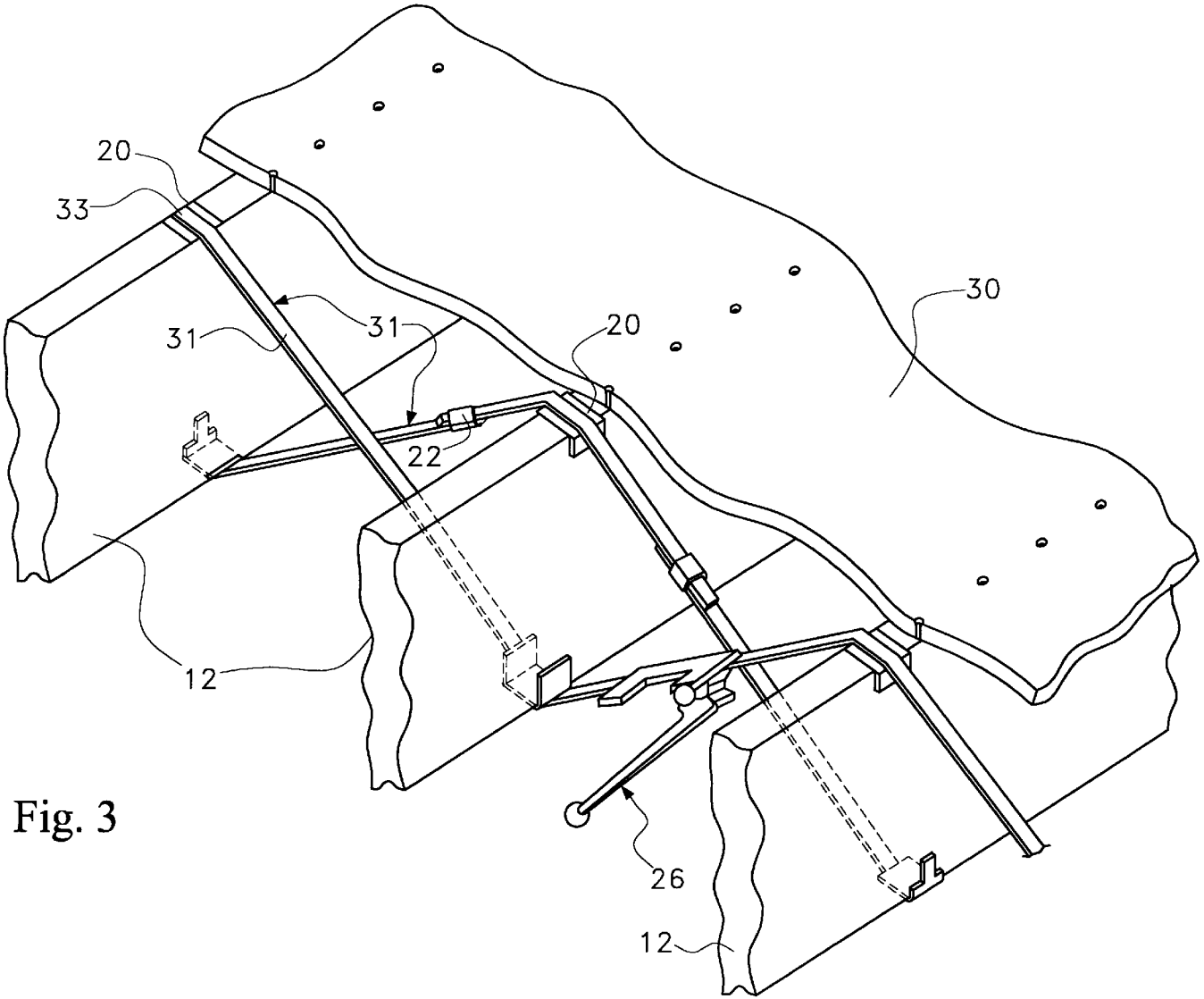
FIG. 3 is a perspective view of the floor joist arrangement of FIG. 1, showing a third exemplary embodiment of the present invention bridging structure.

Referring to FIG. 3, a third embodiment of the present invention bridging construction is shown. In this embodiment, the flexible bridging elements 31 are made of pieces of strapping that start at one joist, extend across an adjacent joist and reach toward a third joist. In the shown embodiment, one end 33 of a long flexible strap 32 is attached to either the top or the bottom of a joist 12. The flexible strap 32 is then passed over the opposite top or bottom end of an adjacent joist, and the flexible strap 32 is continued toward the third subsequent joist. In the shown embodiment, the flexible strap 32 is long enough to extend from a first joist, over a second joist and half way to a third joist. However, it will be understood that the long flexible strap 32 can be made of any length and may weave across the tops and bottoms of any plurality of joists and is not limited to the two joists shown. Furthermore, the length of the long flexible strap 32 is constructed so that the long flexible strap ends in the interstice between joists. As such, the long flexible strap 32 can be joined to another strap that overlaps the long flexible strap 32 and is aligned along the same line as the flexible strap 32. Consequently, a continuous line of strapping is formed across all the joists 12 that repeatedly passes across the bottom edges and top edges of adjacent joists. Since any one strap 32 may extend over any plurality of joists 12, the number of straps and interconnections between straps is greatly reduced over the requirements of the previous embodiments.

As with the previous embodiments, the shown straps 32 are joined utilizing a flexible strapping tensioner device 26 that connects the straps 32 with a seal connector 22 or sealless joint. Each strap 32 can be directly fastened to each of the joists 12 that the strap 32 passes. However, in a preferred embodiment, the straps 32 are attached to the joists 12 utilizing metal support brackets 20 that will be later described in detail.

The flexible straps shown in the embodiments of FIG. 1, FIG. 2 and FIG. 3 can be directly nailed to the joists. The nails can either be driven directly through the flexible straps or the flexible strapping can be prefabricated with multiple nail holes. However, in a preferred embodiment, the various flexible straps are not directly nailed to the joists, but rather are joined to, or used in conjunction with, support brackets that are positioned between the flexible straps and the below lying joists. The support brackets prevent the flexible straps from crushing the joist as the flexible straps are tightened. Consequently, the joist does not deform under the forces of the flexible straps and does not lessen the rigidity of the strapping connections between joists.

Figure 4:
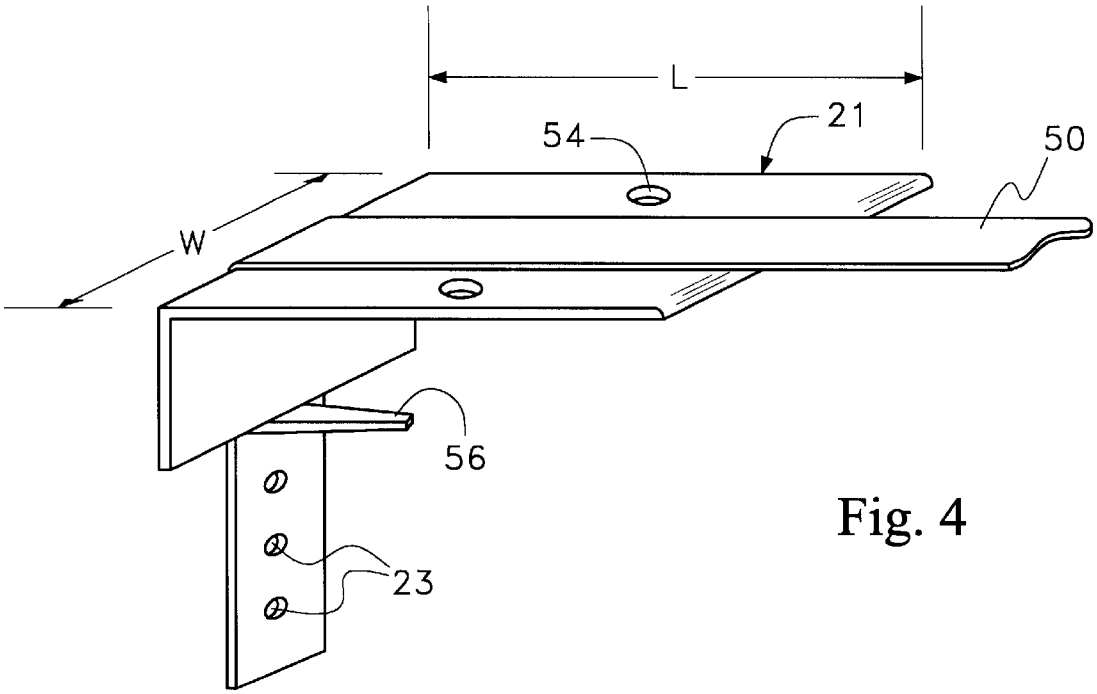
FIG. 4 is a perspective view of one embodiment of an end support bracket used to support the flexible strapping of the present invention on each joist.

Referring to FIG. 4, a first embodiment of an end support bracket 21 is shown in conjunction with the end of a piece of flexible strapping 50. The end support bracket 21 has an L-shaped profile that allows the end support bracket 21 to fit over the top of a joist. The long surface of the end support bracket 21 has a length L that is equal to the top surface width of a joist onto which the end support bracket 21 will be applied. The end support bracket 21 may optionally include nail holes 54 so that the end support bracket 21 can be nailed to a joist 12. Similarly, the end support bracket 21 can be manufactured with unistructural nails 56 that can be used to directly join the end support bracket 21 to a joist. Furthermore, any other conventional means of mechanically or adhesively joining the end support bracket 21 to a joist can be applied. The length L of the end support bracket 21 is equal to the joist thickness. As such, the edges of the end support 21 align with the edges of the top surface of a joist. The end support bracket 21 therefore supports the flexible strapping 50 as the strapping 50 turns across the edges of a joist. To prevent damage to the flexible strapping 50, the edges of the end support bracket 21 can be slightly rounded, so as not to cut into the flexible strapping 50 as the strapping is tightened. The dimensions and materials of the end support bracket 21 are engineered so as to limit bearing pressure on the joist on which the end support bracket 21 is attached. However, the width W of the end support bracket 21 will always be at least as wide as the width of the flexible strapping 50.

The flexible strapping 50 passes over the end support bracket 21. The flexible strapping 50 can simply pass over the end support bracket 21 and be directly nailed to the joist through nail holes provided in the strap, or the flexible strapping 50 can be welded or otherwise directly attached to the end support bracket 21, whereby the end support bracket 21 itself would connect the flexible strapping 50 to the joist. Nail holes 23 may be disposed along the flexible strapping 50 to help facilitate the nailing of the strapping to the joist.

It will be understood that using a pneumatic nailing device or a cartridge driven nailing device, that fasteners can be driven through both the flexible strap and the below lying support bracket. The use of such fasteners, driven through both the flexible strapping and the support bracket, produces a more rigid connection since preformed nail holes are not used. It should also be understood that fasteners can also be driven through the floor deck, in addition to the flexible strapping and support bracket, provided there is careful alignment.

Figure 5:
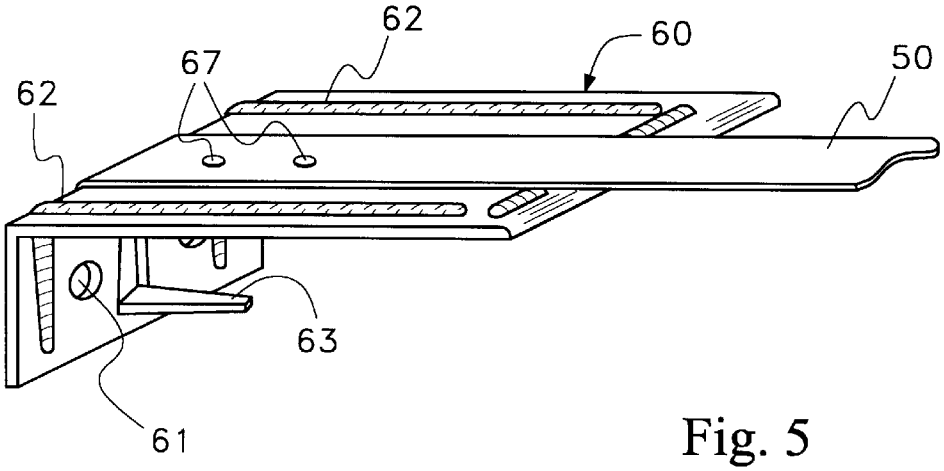
FIG. 5 is a perspective view of a second embodiment of an end support bracket.

Referring to FIG. 5, an alternate embodiment of an end support bracket 60 is shown in conjunction with the end of a piece of flexible strapping 50. In this embodiment, the end support bracket 60 includes a plurality of reinforcement ribs 62 that stiffen the structure of the end support bracket 60. The reinforcement ribs 62 help prevent the end support bracket 60 from bending under the force of the flexible strapping 50 as the flexible strapping 50 is tightened. The end support bracket 60 may optionally include nail holes 61 and/or unistructural nails 63 that can be used to fasten the end support bracket 60 to the joist. The flexible strapping 50 can simply pass over the end support bracket 60 and be directly nailed to a joist, or the flexible strapping 50 can be welded, at resistance weld points 67, or otherwise mechanically or adhesively attached to the end support bracket 60, whereby the end support element 60 itself would connect the flexible strapping 50 to a joist.

Figure 6:
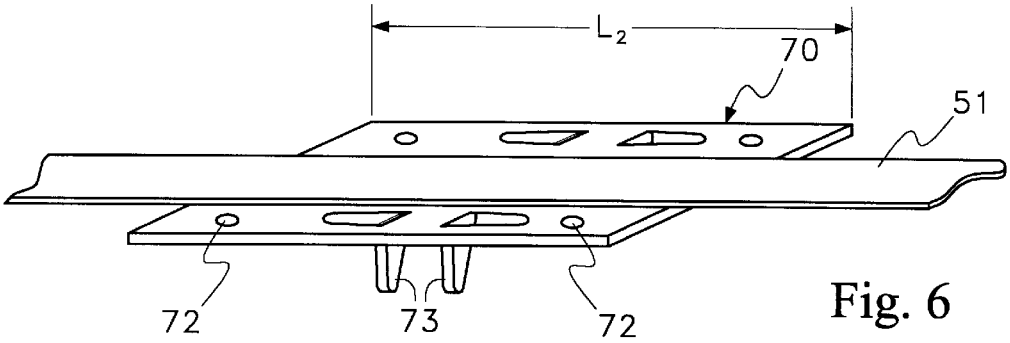
FIG. 6 is a perspective view of one embodiment of a center support bracket used to support the flexible strapping of the present invention as the strapping passes across a joist.

In the embodiment of the present invention shown in FIGS. 2 and 3, the flexible strapping passes either over the top or the bottom of a joist 12 as a continuous piece. Referring now to FIG. 6, a first embodiment is shown for a center support bracket 70 that can be used to support a piece of flexible strapping 51 as it passes over a joist. The center support bracket 70 can simply be a piece of metal which is mechanically or adhesively joined to the top or bottom edge of a joist. The length L2 of the center support bracket 70 is equal to the thickness of a joist so that the edges of the center support bracket 70 align with the side edges of the joist. As such, the center support bracket 70 supports the flexible strapping 51 as the flexible strapping 51 bends and passes over the center support bracket 70. The center support bracket 70 may optionally include nail holes 72 and/or unistructural nails 73 to facilitate the attachment of the center support bracket 70 to a joist. The flexible strapping 51 can simply pass over the center support bracket 70, or the flexible strapping 51 can be welded or otherwise mechanically or adhesively attached to the center support bracket 70, whereby the center support bracket 70 itself would connect the flexible strapping 51 to a joist. The edges of the center support bracket 70 may also be slightly rounded so as not to cut into the material of the flexible strapping 51 as the strapping 51 is tightened over the center support bracket 70.

Figure 7:
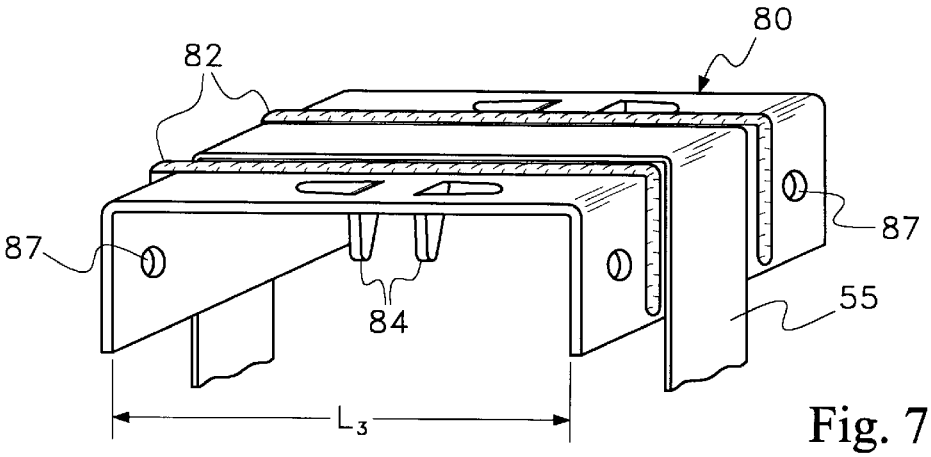
FIG. 7 is a perspective view of a second embodiment of a center support bracket.

Referring to FIG. 7, an alternate embodiment of the center support bracket 80 is shown, wherein the center support bracket is U-shaped. In this embodiment, the length L3 between the parallel sides of the center support bracket 80 is generally equivalent to the width of the joist onto which the central support bracket 80 will be placed. As such, the center support bracket 80 can be placed over the top or bottom edge of a joist. In the shown embodiment, the center support bracket 80 includes a plurality of reinforcement ribs 82. The reinforcement ribs 82 act to stiffen the structure of the center support 80 and also act to guide the flexible strapping 55, helping hold the strapping 55 in the center of the bracket 80. The center support bracket 80 may be optionally manufactured with nail holes 87 or may have unistructural nails 84 integrally formed as part of its structure. As such, the center support bracket 80 can be directly attached to a joist. The flexible strapping 55 can simply pass over the center support bracket 80, or the flexible strapping 55 can be welded or otherwise mechanically or adhesively attached to the center support bracket 80, whereby the center support bracket 80 itself would connect the flexible strapping 55 to the joist 12. The edges of the center support bracket 80 may also be slightly rounded so as not to cut into the flexible strapping 55 as the strapping 55 is tightened over the center support bracket 80.

Figure 8:
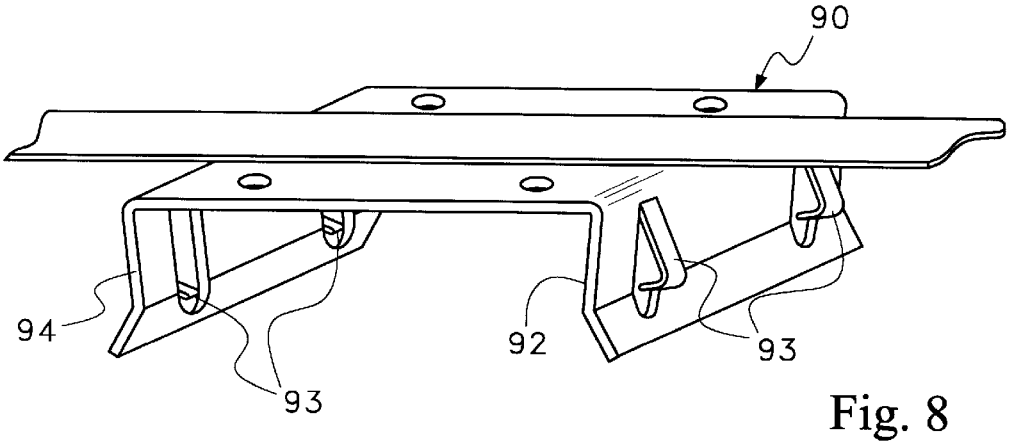
FIG. 8 is a perspective view of a third embodiment of a center support bracket.

Referring to FIG. 8, a third embodiment of a central support bracket 90 is shown having a generally U-shaped profile with convergent side walls 92, 94. The convergent side walls 92, 94 are formed with an inherent spring constant so that the walls 92, 94 can be resiliently separated to a length that allows the central support bracket 90 to be placed over the top or bottom edge of a joist. Once placed over the top or bottom edge of a joist, the spring bias created by the side walls 92, 94 help retain the central support bracket 90 into a set position. The central support bracket 90 may optionally include nail holes 91 and/or unistructural nails 93 so that the central support bracket 90 can be directly attached to a joist.

It will be understood that the embodiments of FIGS. 6, 7 and 8 are merely exemplary and any of the shown features from each embodiment can be combined in configurations not specifically shown or described.

When applying an end support bracket, such as is shown in FIGS. 4 and 5, or a center support bracket, as is shown in FIGS. 6, 7 and 8, to a joist, the thickness of the various brackets may prevent the floor sheathing from adequately resting upon the joist. A perceptible rise in the flooring could result which may also result in unsupported soft spots. Similarly, contact noises may develop in the floor at the locations of the soft spots. To prevent this from occurring, material from either the joist or the floor sheathing is displaced or removed to compensate for the size of both the bracket being used and the thickness of the strapping passing over the bracket. Otherwise material can be added to the top of each joist so as to compensate for the thickness of the brackets and the strapping between the joist and the flooring.

Figures 9A, 9B, 10A, 10B:
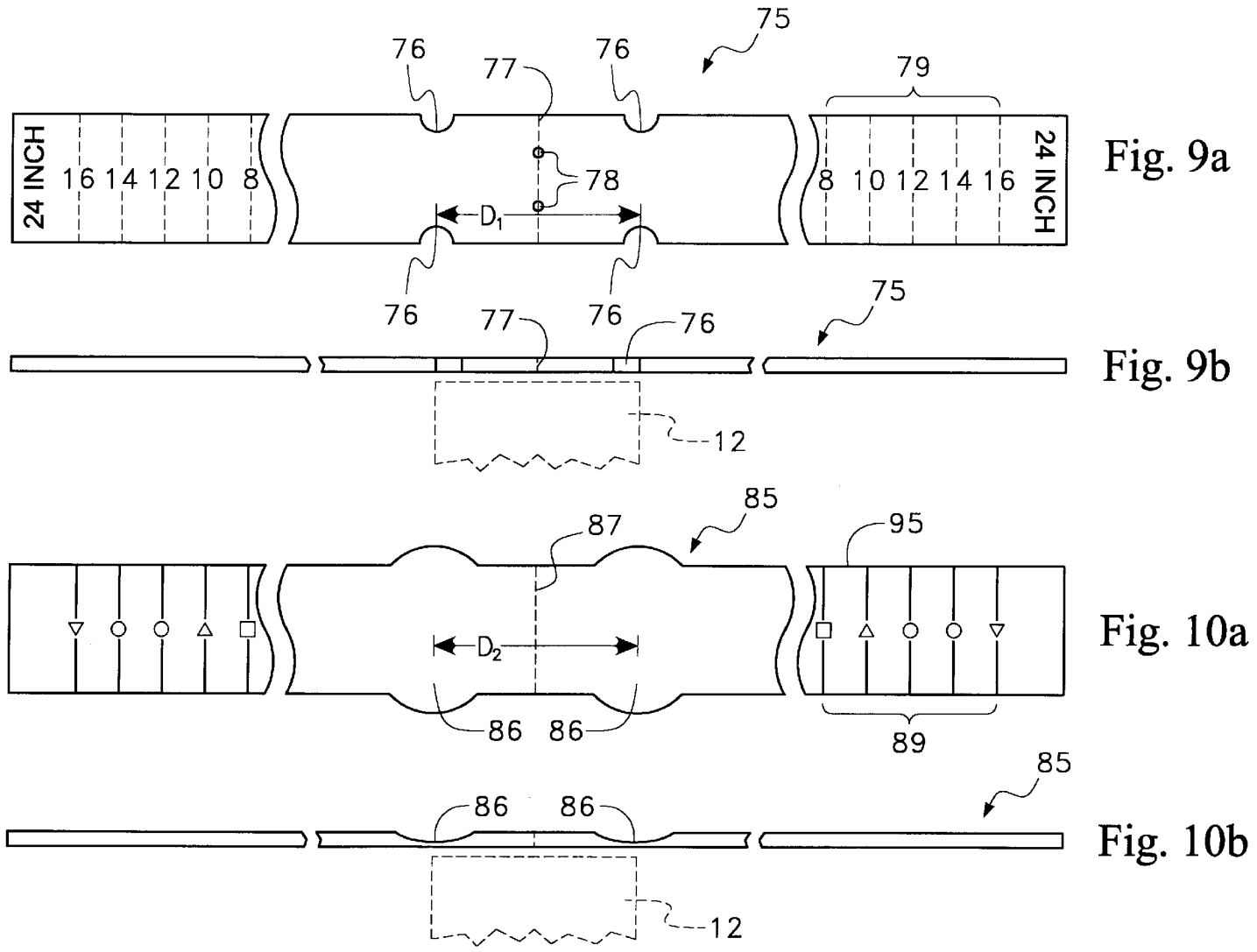
FIG. 9*a* is a top view of one preferred embodiment of the strapping used in the present invention.
FIG. 9*b* is a side view of the embodiment shown in FIG. 9*a;*
FIG. 10*a* is a top view of a second preferred embodiment of the strapping used in the present invention.
FIG. 10*b* is a side view of the embodiment shown in FIG. 10*a;*

In the embodiments of FIGS. 1, 2 and 3, solid strips of flexible strapping are used to create the needed bridging between joists. As has been previously indicated, the flexible strapping is preferably made of metal, such as steel, however, other materials such as synthetic fiber strapping may also be used. Referring to FIGS. 9*a* and 9*b*, an alternate embodiment for the flexible strapping 75 used in conjunction with the present invention is shown. In this embodiment, the flexible strapping 75 is fabricated from steel and has a plurality of reliefs 76 formed along its edges. The reliefs 76 are evenly disposed on either side of the flexible strap 75, opposite one another. On either side of the flexible strap 75, the reliefs 76 are spaced apart by a distance D1. The distance D1 is the same as the width of the joist 12 onto which the flexible strap 75 will be applied. As a result, the reliefs 76 permit the flexible strap 75 to more easily bend, without kinking, around the corners of the joist 12 or around the corners of a support bracket attached to the joist 12 below the flexible strap 75.

In the shown embodiment of FIG. 9*a*, there is also shown an alignment line 77 evenly disposed between the reliefs 76. The alignment line 77 can be any visual indicator manufactured onto the flexible strap 75 that would help a person properly position the flexible strap 75 over a joist. For instance, to properly position the flexible strap 75 on a joist or over a support bracket, the installer need only align the alignment line 77 in the center of the joist or support bracket. Preformed nail holes 78 may optionally be formed along the alignment line 77 thereby allowing an installer to properly nail the flexible strap 75 to the center point of a joist.

Measurement indicia 79 are also shown in FIG. 9*a* near both ends of the flexible strap 75. The measurement indicia 79 may correspond to the joist depth, i.e. 8, 10 or 12 inches and/or the joist spacing, i.e. 12, 16, 24 inches. As such, an installer can choose the proper sized strapping for a given installation job and the installer has a visual indication as to how far each of the flexible straps should overlap each other between the joists.

In FIGS. 10*a* and 10*b*, a second alternate embodiment for flexible strapping 85 is shown. In this embodiment, two reliefs 86 are formed in the strapping 85 across the width of the strapping 85. The width of the strapping may increase over the region of the reliefs to compensate for diminished material thickness. As in the previous embodiment, the spacing between the reliefs 86 is a distance D2, which is equivalent to the spacing of the joist 12 or the support bracket onto which the strapping 85 will be applied. As a result, the reliefs 86 permit the flexible strap 85 to more easily bend, without kinking, around the corners of the joist 12 or around the corners of a support bracket attached to the joist 12 below the flexible strap 85. This embodiment also includes a visible alignment line 87 that enables an installer to properly position the flexible strap 85 in the center of a joist 12 or a support bracket.

In the embodiment of 10*a*, there are shown symbols 89 near both ends of the flexible strap 85. The symbols 89 correspond to various joist depths and joist spacings that may be encountered when installing the present invention bridging system. The symbols 89 may be color coded and help the installer properly install the flexible straps 85. For example, if bridging is being installed on 2×10 inch joists spaced 24 inches apart, the installer may want to tighten the various installed straps so that adjacent straps overlap to the point of the blue triangle symbol 95, whereas a red triangle might indicate 2×10 inch joists on 16 inch centers. By aligning the straps to this symbol, the installer can tell that a proper installation has been performed for that given sized joist depth and spacing. It will therefore be understood that symbols can be manufactured on the flexible strapping for any joist depth and spacing combination.

In the above described embodiments, the present invention bridging construction has been applied to solid sawn wooden joists. However, as will be recognized by a person skilled in the art, bridging is also commonly used with wood web joists, parallel chord wood trusses, wood laminate beams, metal I-beam joists, prefabricated truss joists, or any other used joist.

Figure 11:
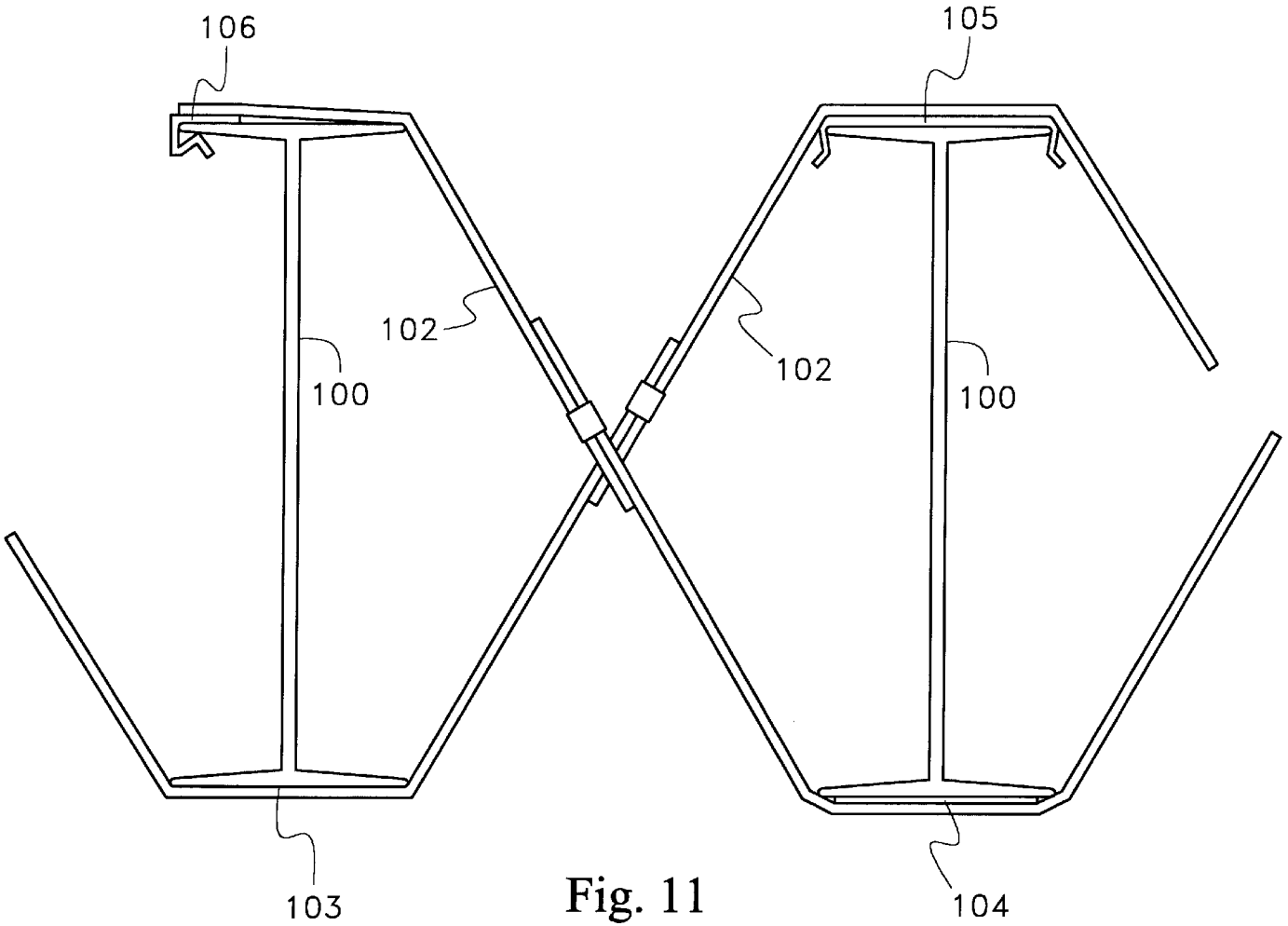
FIG. 11 is a side view of a joist construction utilizing metal I-beam joists in conjunction with the present invention bridging structure.

Referring to FIG. 11, a plurality of metal I-beam joists 100 are shown in conjunction with the present invention flexible strapping bridging. The flexible bridging elements 102 can pass directly over a joist 100 such as is shown at point 103, and can be directly attached to the joist 100 with either welding, brazing, adhesive or mechanical fasteners. In an alternate installation method, the flexible bridging elements 102 can be attached to a support brackets, that is juxtaposed between the joist 100 and the strapping 102, with either a weld, braze, adhesive or mechanical fastener. The support bracket can be welded, brazed, adhered or mechanically fastened to the joist. For attachment in the field, a support bracket thicker than the strapping material may be more suitable for some welding processes and mechanical fasteners. The center support bracket 104 can simply be a piece of metal similar to support bracket 70 shown in FIG. 6 without the unistructural nails 73. However, in the case of metal joists, the width of the support bracket need not correspond to the flange width of the metal joist 100. As can be seen in FIG. 11, a center support bracket 105 may also be shaped to snap fit over the joist 100 with a spring bias that restrains the support bracket 105 in a set position upon the joist 100, similar to center support bracket 90 shown in FIG. 8, without the unistructural nails 93. As in the embodiment of FIG. 8, when one end of the flexible bridging element 102 is to be joined to the flange of the metal joist 100, a hook shaped end support bracket 106 can be used to engage the flange of the joist 100. The outer end of the hook can be formed with a spring bias which allows the end support bracket 106 to be snapped onto a range of flange thicknesses.

The present invention can be used to create bridging in a new construction or can be retroactively applied to existing constructions to replace inferior bridging. For example, the flexible straps of the present invention can be attached to a joist before the joist is positioned in a floor construction. The flexible straps can therefore be connected to the joists on a suitable work surface either on-site or off-site of the construction.

Access to the underside of the floor is often restricted in floors constructed over crawl spaces or in prefabricated housing factories. To allow for tensioning and sealing from the top side of the floor and to still take advantage of the restraining behavior of the floor sheathing during strap tensioning, the floor sheathing may be installed to one side of the line of bridging. After bridging installation is completed, the remaining floor sheathing is installed. Alternatively, a rigid member aligned with the line of bridging can be temporarily fastened to the joist for the same restraining purpose. The rigid member can be permanently installed in cases where no sheathing is to be installed.

In a retroactive construction, the flexible straps of the present invention can be inserted into any opening made in between a joist and the floor sheathing. This method does not require the complete removal of the floor sheathing since the support brackets that join the flexible straps can be inserted between both the floor sheathing and the joists.

Figure 12:
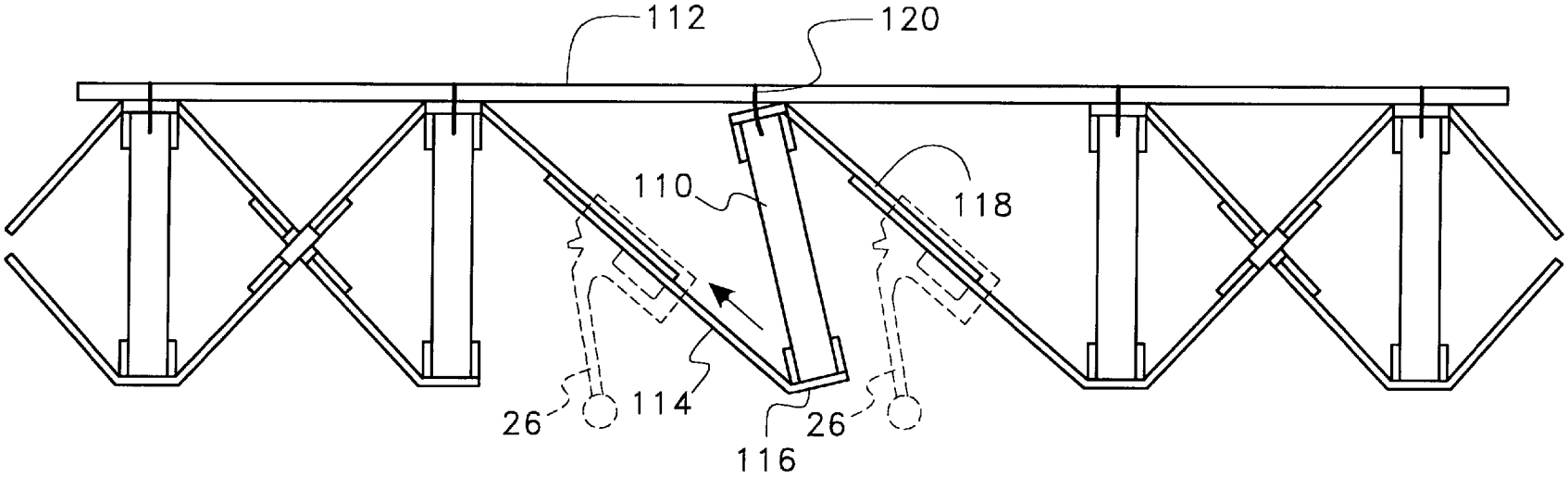
FIG. 12 is a side view of a joist construction having one tilted joist to illustrate how the present invention bridging structure can be used to straighten the tilted joist.

The present invention bridging can be used to level bowed, sagging or twisted joists by selectively correcting such deformed joists along the line of bridging. It is preferable that the floor sheathing is attached to the joists before undertaking the corrections. Referring to FIG. 12, a flooring construction is shown having a tilted joist 110. The tilted joist 110 is less stiff than the other vertical joists, as such, a soft spot exists in the flooring 112. The joists on either side of the tilted joist 110 are all interconnected utilizing the present invention flexible bridging as has been previously described. Consequently, each of the joists, other than the tilted joist 110, are attached to other joists using the present invention flexible bridging elements arranged in a standard X-shaped configuration. The tilted joist 110, however, only has one flexible bridging element 114 attached to its bottom edge 116. As the flexible bridging element 114 is tightened by a strapping tensioner device 26, the tilted joist 110 is biased back into a vertical position. A second flexible bridging element 118 is attached to the top edge 120 of the tilted joist 110. The second flexible bridging element 118 is also tightened by a strapping tensioner device 26 so as to prevent the top edge 120 of the tilted joist 110 from moving relative the flooring 112 as the first flexible bridging element 114 is tightened. The joists adjacent to the tilted joist 110 are prevented from moving when the first and second flexible bridging elements 114, 118 are tightened by the bridging that joins the untilted joists together and spreads the loads evenly among the untilted joists. Once the tilted joist 110 is correctly positioned, the first and second flexible bridging elements 114,118 can be sealed at the tension needed to correct the tilted joist 110. Consequently, the joist 110 is retained in a vertical position and the soft spot in the flooring construction is corrected.

Figure 13:
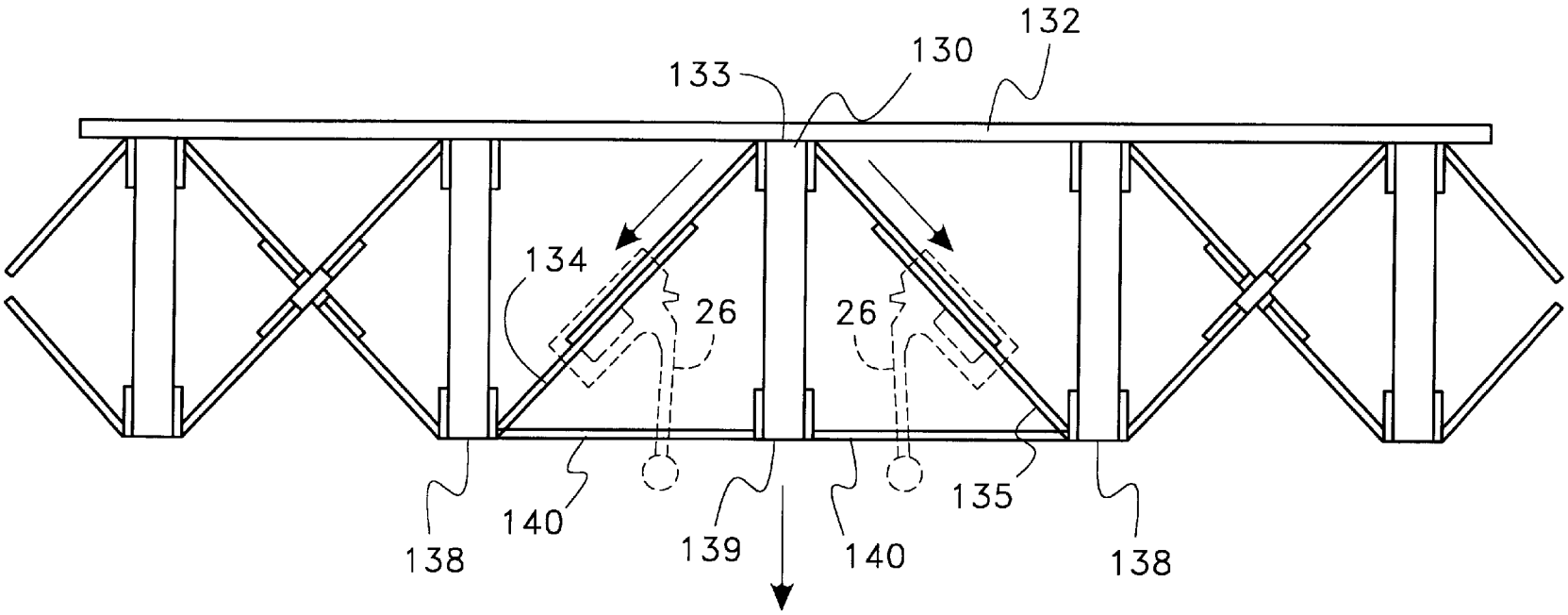
FIG. 13 is a side view of a joist construction having one high joist to illustrate how the present invention bridging structure can be used to lower a high joist.

Referring to FIG. 13, a flooring construction is shown having a high joist 130 that causes a high point in the flooring 132. Flexible bridging elements 134, 135 are attached to the top edge 133 of the high joist 130, joining the top edge 133 of the high joist 130 to the lower edges 138 of the two adjacent joists. A compression strut 140 can be optionally positioned on both sides of the high joist 130 proximate its lower edge 139. The compression strut 140 joins the high joist 130 to the two adjacent joists, preventing the lower edges 138 of the two adjacent joists from bending toward the high joist 130 as the flexible bridging elements 134, 135 are tightened. Furthermore, the joists adjacent to the high joist 130 are interconnected utilizing the present invention bridging construction as has been previously described. Consequently, each of the joists other than the high joist 130 are attached to other joists using the present invention bridging in the conventional X-shaped configuration. As the flexible bridging elements 134, 135, attached to the top edge 133 of the high joist 130, are tightened by strapping tensioner devices 26, the high joist 130 is forced downward into a plane, flush with the adjacent joists. Consequently, the high spot in the flooring 132 is corrected.

Figure 14:
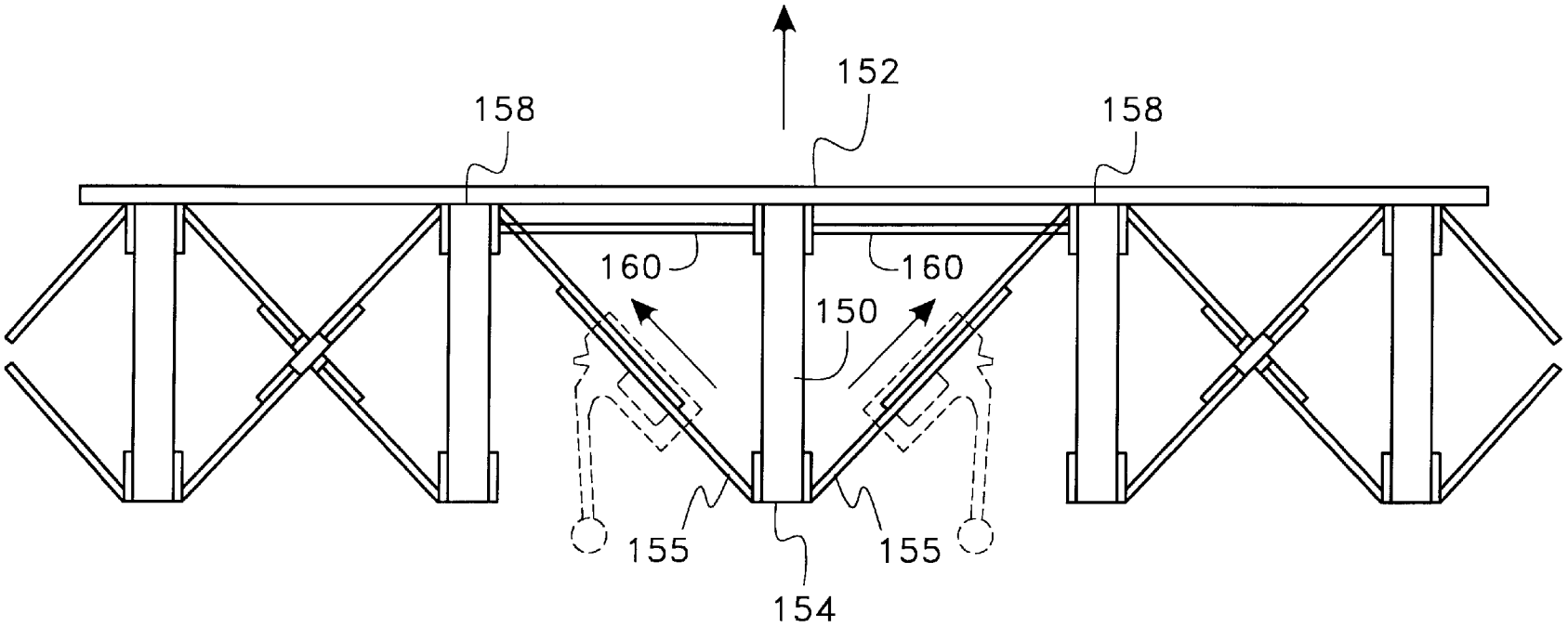
FIG. 14 is a side view of a joist construction having one sagging joist to illustrate how the present invention bridging structure can be used to raise a sagging joist.

Referring to FIG. 14, a flooring construction is shown having a sagging joist 150 that creates a low point in the flooring 152. Flexible bridging elements 153, 155 are attached to the bottom edge 154 of the sagging joist 150, joining the bottom edge 154 of the sagging joist 150 to the upper edges 158 of the two adjacent joists. Depending upon the stiffness of the flooring 152, optional compression struts 160 can be positioned between the sagging joist 150 and the two adjacent joists, proximate the flooring 152. The compression strut 160 prevents the upper edges 158 of the two adjacent joists from bending toward the sagging joist 150 as the flexible bridging elements 153, 155 are tightened. The flexible bridging elements 153, 155 are tightened using a strapping tensioner device 26. As the flexible bridging elements are tightened, the sagging joist 150 is forced upward into a plane, flush with the adjacent joists. Consequently, the low spot in the flooring 152 is corrected.

The above descriptions of the correction of misaligned joists are exemplary. The floor sheathing connection to the joists, strap tensioning and/or adjustments in overlapping strap length can be made in any sequence necessary to correct misaligned joists.

Figure 15:
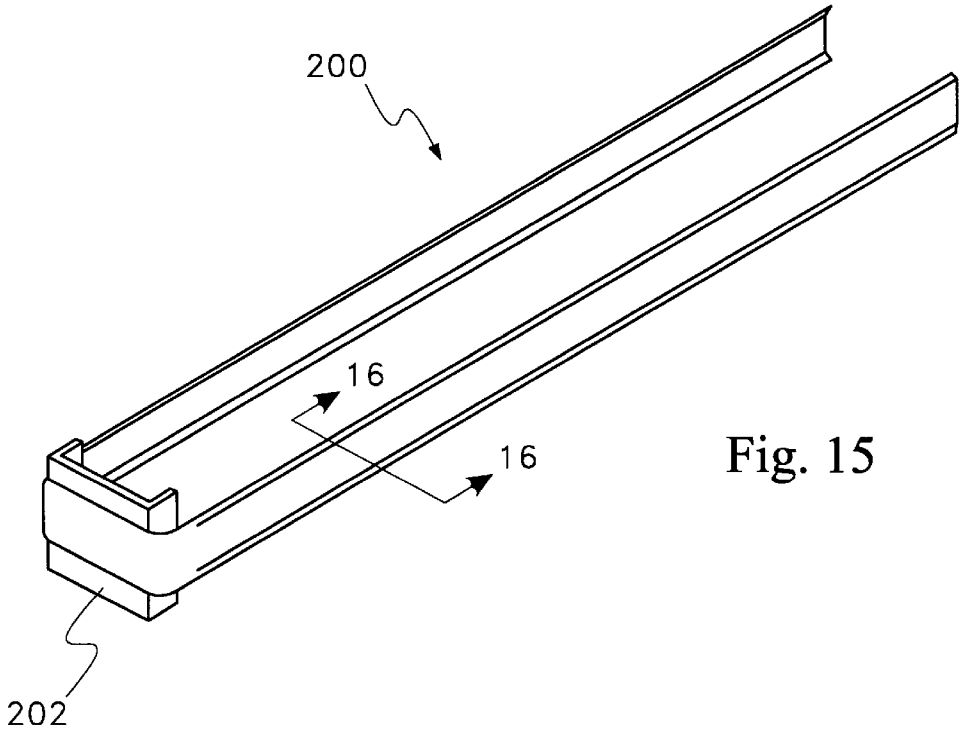
FIG. 15 is a perspective view of a preferred embodiment a flexible strapping element utilizing profiled strapping.
Figure 16A:
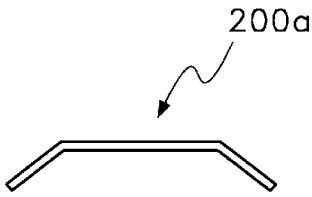
FIG. 16*a* is a cross sectional view of the profiled strapping of FIG. 15, viewed along section line 16—16.
Figure 16B:
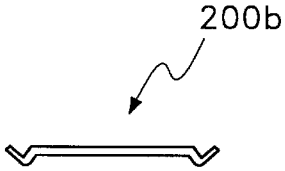
FIG. 16*b* is an alternate shape for the cross section of the profiled strapping.
Figure 16C:
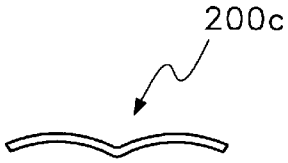
FIG. 16*c* is a second alternate shape for the cross section of the profiled strapping.
Figure 16D:
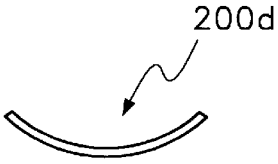
FIG. 16*d* is a third alternate shape for the cross section of the profiled strapping.

Referring to FIG. 15 and FIG. 16*a*, a strapping element 200 is shown that does not have a flat cross section. Rather, the cross section of the strapping element is contoured in a manner that adds a small amount of rigidity to the strapping. In the shown embodiment, the strapping is longitudinally bent at an obtuse angle along both sides of the strapping element 200. As can be seen from FIG. 15 the bends in the strapping element 200 are formed in a manner so that the strapping element 200 flattens out when it is installed and pulled taught over a rigid object such as the end of a joist. The flattening out of the bends in the strapping element 200 enables the strapping element 200 to lay flush against the joist as it bends around the joist. In FIG. 15, a support bracket 202 is shown. As the strapping is pulled taught across the support bracket 202, the strapping element 200 fattens and conforms to the support bracket 202 in the same manner as would a flat piece of strapping. Referring to FIG. 16*b*, FIG. 16*c* and FIG. 16*d*, it can be seen that the strapping element 200*b*, 200*c* and 200*d*, respectively, can be bent into any one of a number of configurations. In each instance, the longitudinal bend provided to each strapping element provides a degree of longitudinal rigidity to the strapping in a manner that can readily flatten out should the strapping be pulled taught across a joist or other rigid structure. It should be understood that the different strapping profiles illustrated in FIGS. 16*a*, 16*b*, 16*c* and 16*d* are all merely exemplary and there are many other profiles that can be used. A person skilled in the art would recognize dozens of profile configurations that would act to add a small degree of stiffness to the strapping elements. Any such strapping profile could be substituted for the few profiles shown.

Figure 17:
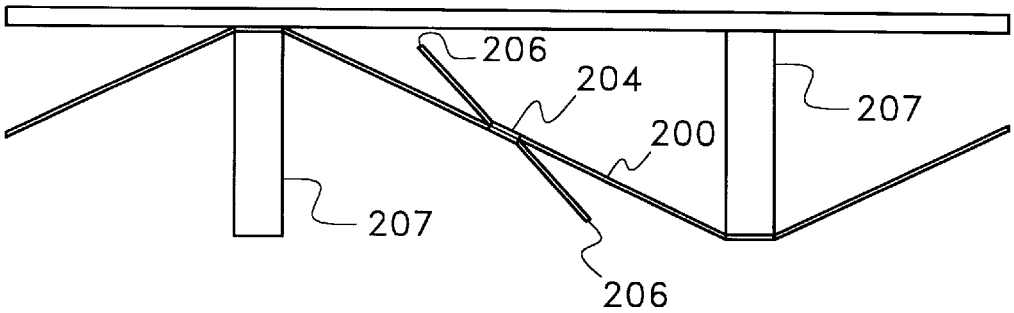
FIG. 17 is a side view of a joist construction utilizing the flexible strapping elements of FIG. 15.

Although providing profile bends to the strapping element 200 in FIG. 15 does provide some small degree of compression strength to the strapping element 200, the degree of compression strength is nominal and provides no significant rigidity to the overall joist structure. Rather, the purpose of providing profile bends in the strapping element 200 is to prevent vibrational noise in the bridging caused by the shock of sudden loads or moving loads on the flooring above the joists. Referring to FIG. 17 it can be seen that when the strapping elements 200 with profile bending are joined together with a mechanical crimp 204, the bends in the strapping cause the free ends 206 of the strapping elements 200 to be biased away from the portions of the strapping elements that are under tension. Consequently, the free end 206 of each strapping element 200 does not abut against the strapping that is under tension. As a result, when the joists 207 experience vibrations due to moving loads, i.e a person walking across the floor, the vibrations do not cause contact between the free ends 206 and the remainder of the strapping element 200. The lack of contact prevents noise in the bridging, making for a more quiet construction.

Figure 19:
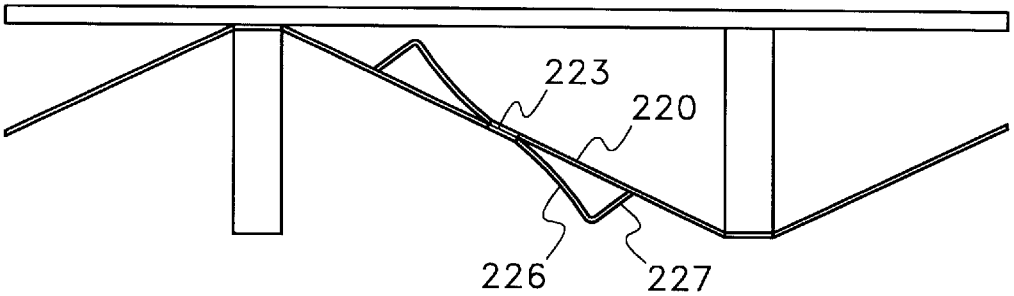
FIG. 19 is a side view of a joist construction utilizing the flexible strapping elements of FIG. 18.
Figure 18:
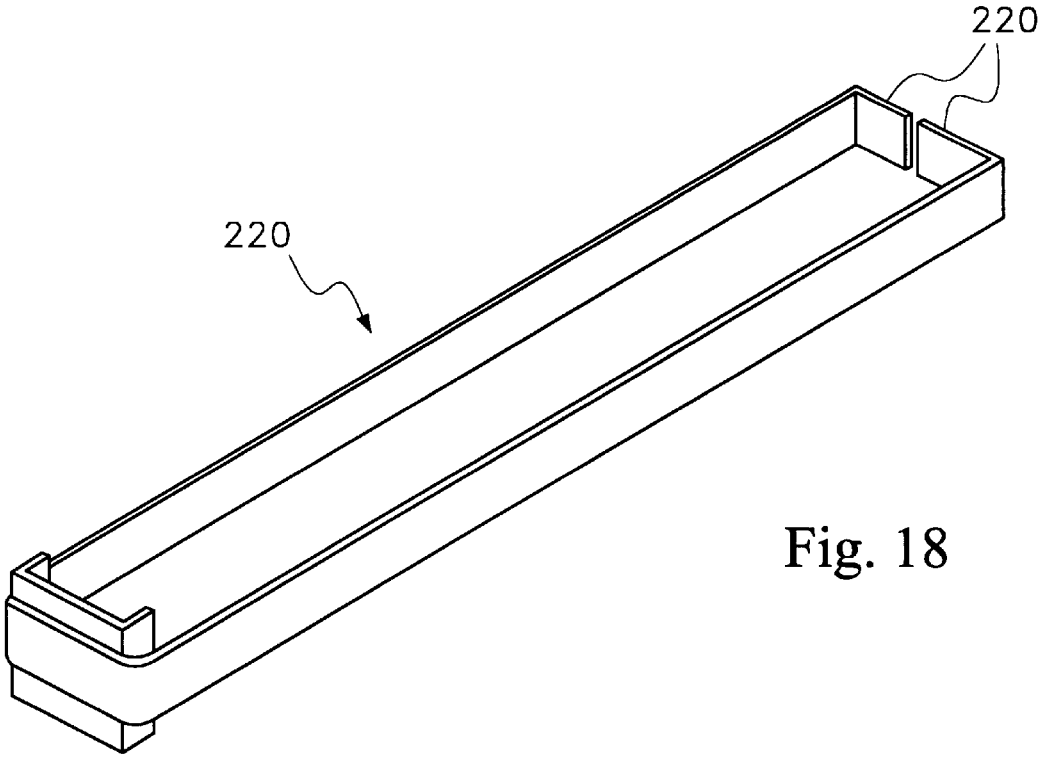
FIG. 18 is an alternate embodiment of a flexible strapping element utilizing flexible strapping.

Referring to FIG. 18 an alternative embodiment of the present invention strapping element 220 is shown. In this embodiment, the strapping could be contoured, but is preferably flat. In the shown embodiment, the ends of each strapping element 220 is bent at a near perpendicular angle. Referring to FIG. 19, it can be seen that as two strapping elements 220 are joined by a mechanical crimp 223, the bends near the free portion 226 of the strapping elements

220 causes the end 227 of the strapping to be biased against the used portion of the strapping element 220. The contact of the end 227 against the remainder of the strapping element 220 pre-stresses the free portion 226 of the strapping. The pre-stressed condition prevents the free portion 226 of the strapping from vibrating and making noise when the joists in the construction experience moving loads.

Figure 20:
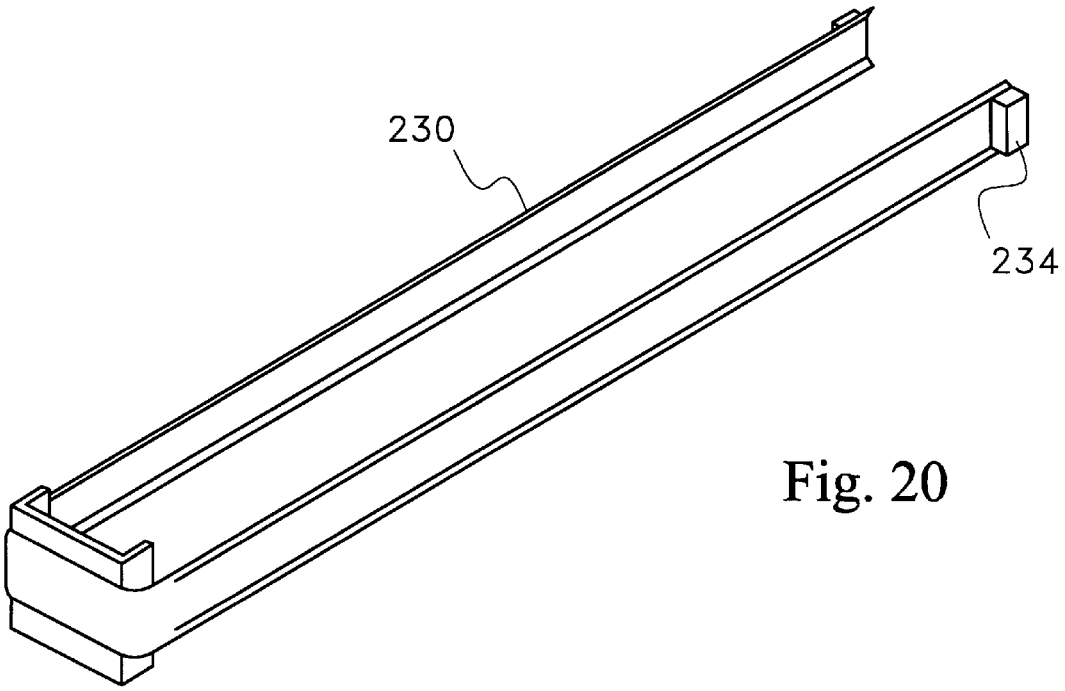
FIG. 20 is a second alternate embodiment of a flexible strapping element utilizing profiled strapping with padded ends.

Referring to FIG. 20 yet another embodiment of the present invention strapping element 230 is shown, wherein the strapping element is specifically designed to prevent vibrational noises when installed on joists. In the shown embodiment, a block of padding 234, such as foam rubber or styrofoam, is attached to the strapping element near each of its two ends. As can be ascertained, when two such strapping elements 230 are assembled into a joist construction, such as in FIG. 19 or FIG. 17, the block of padding 234 would be the only portion of the free end of the strapping element to contact the used portion of the strapping element 230 should vibrations occur. Consequently, the block of padding 234 would prevent contact of the free end of strapping and would eliminate noise in the bridging from vibrations.

Although the above described embodiments of the present invention bridging arrangements are believed to represent the best mode of the present invention, it will be understood that many of the individual elements illustrated and described have known functional equivalents. Additionally, dimensions and proportions among the various elements may also be altered as desired by a person skilled in the art. All such modifications and additions are intended be covered by the scope of this invention as set forth in the appended claims.

What is claimed is:

1. An assembly comprising:

joists containing at least a first joist and a second joist at least one first flexible strap adapted to engage the first joist;

at least one second flexible strap adapted to engage the second joist; and connecting means for connecting said at least one first flexible strap to said at least one second flexible strap at a connection point between the first joist and the second joist, wherein said connecting means connects said at least one first flexible strap to said at least one second flexible strap at a predetermined tension that causes both said at least one first flexible strap and said at least one second flexible strap to be taut, thereby creating bridging between the first joist and the second joist.

2. The assembly according to claim 1, further including a first fastening means capable of fastening said at least one first flexible strap to the first joist and a second fastening means capable of fastening said at least one second flexible strap to the second joist.

3. The assembly according to claim 2, wherein both the first joist and the second joist have a top edge surface and a bottom edge surface, and a predetermined distance exists between the top edge surface and the bottom edge surface, wherein said first flexible strap and said second flexible strap both have lengths shorter than said predetermined distance.

4. The assembly according to claim 3, wherein said first flexible strap has a first end and a second end, and said second flexible strap has a first end and a second end, wherein said connecting means couples said second end of said first flexible strap to a point proximate said fisrt end of said second flexible strap, thereby creating a flexible structure having a length longer than said predetermined distance.

5. The assembly according to claim 2, wherein said first flexible strap has a first end and a second end, and said second flexible strap has a first end and a second end, wherein said first fastening means is coupled to said first flexible strap proximate said first end of said first flexible strap and said second fastening means is coupled to said second flexible strap proximate said first end of said second flexible strap.

6. The assembly according to claim 2, further including support means for supporting said at least one first flexible strap and said at least one second flexible strap, wherein said support means is positionable between said first flexible strap and the first joist and said second flexible strap and the second joist, thereby preventing the first flexible strap and the second flexible strap from damaging the first and second joists, respectively.

7. The assembly according to claim 6, wherein said first flexible strap and said second flexible strap both have a predetermined width and said support means includes a substantially rigid member that has a width wider than said predetermined width.

8. The assembly according to claim 7, further including means for joining said support means to the first joist and the second joist, respectively.

9. The assembly according to claim 7, further including joining means for joining said at least one first flexible strap and said at least one second flexible strap to said support means.

10. The assembly according to claim 1, further including a joining means for selectively joining said at least one first flexible strap and said at least one second flexible strap to the first joist and the second joist, respectively, and to any subsequent joists disposed between the first joist and the second joist that said at least one first flexible strap and said at least one second flexible strap pass.

11. The assembly according to claim 10, wherein said joining means includes at least one substantially rigid member that is positionable between said at least one first flexible strap and said at least one second flexible strap and the joists that the flexible straps engage.

12. The assembly according to claim 1, wherein said first flexible strap and said second flexible strap are substantially flat.

13. The assembly according to claim 1, wherein a first flexible strap and said second flexible strap contains bends that run longitudinally along the length of each strap, thereby providing said first flexible strap and said second flexible strap with a degree of stiffness, wherein said bends become flat where said first flexible strap passes over said first joist and second flexible strap passes over said second joist.

14. The assembly according to claim 1, wherein said first flexible strap and said second flexible strap contain longitudinal bends that flatten when biased by said predetermined tension against a rigid surface.

15. The assembly according to claim 1, wherein said first flexible strap and said second flexible strap have reliefs disposed thereon, wherein said reliefs facilitate the bending of said first flexible strap around the contours of the first joist and facilitates the bending of said second flexible strap around said second joist.

16. The assembly according to claim 15, wherein said first flexible strap includes indicia thereon that indicates the proper placement of said strap on a joist.

17. The assembly according to claim 1, wherein said at least one first flexible strap and said at least one second flexible strap include indicia means thereon that correspond to the proper interconnection points between said at least one first flexible strap and said at least one second flexible strap for a given sized first joist and second joist and spacing between said joists.

18. A method of installing bridging among a plurality of joists, comprising the steps of:

attaching at least one first flexible element to a first joist;

attaching at least one second flexible element to a second joist; and joining said at least one first flexible element to said at least one second flexible element at a predetermined tension at a point between the first joist and the second joist.

19. The method according to claim 18, wherein at least one subsequent joist is disposed between said first joist and said second joist, wherein said first joist, said second joist and said at least one subsequent joist have top edge surfaces and bottom edge surfaces, and wherein said method includes weaving said at least one first flexible element and said at least one second flexible element past said at least one subsequent joist.

20. The method according to claim 18, wherein said first joist and said second joist have a top edge surface and a bottom edge surface, whereby said step of attaching at least one first flexible element to said first joist includes attaching said at least one first flexible element to said top edge surface of said first joist and said step of attaching said at least one second flexible element to said second joist includes attaching said at least one second flexible element to said bottom edge surface of said second joist.

21. The method according to claim 18, further including the step of placing a substantially rigid support between said at least one first flexible element and said at least one second flexible element and the joists that said at least one first flexible element and said at least one second flexible element engage.

22. The method according to claim 21, further including the step of securing each said support in a fixed position on each joist.

23. The method according to claim 22, further including the step of affixing each said support to each first flexible element and each second flexible element that each said support engages.

24. In a construction including a plurality of joists, a method of aligning a misaligned joist, comprising the steps of:

attaching at least one first flexible strap to said misaligned joist;

attaching at least one second flexible strap to at least one second joist;

applying tension between said at least one first flexible strap and said at least one second flexible strap, wherein said tension has a resultant force that acts upon said misaligned joist to realign said misaligned joist into a desired orientation; and joining said at least one first flexible strap to said at least one second flexible strap, thereby retaining said misaligned joist in said desired orientation.

25. The method according to claim 24, further including the step of constructing bridging between at least some of said plurality of joists, other than said misaligned joist, whereby said bridging spreads the force of said predetermined tension in said at least one second flexible strap among said plurality of joists joined by said bridging.

26. The method according to claim 24, further including the step of positioning at least one compression member between said misaligned joist and said at least one second joist preventing said misaligned joist from moving beyond a desired distance toward said at least one second joist when said misaligned joist is acted upon by said resultant force.

* * * * *